United States Patent [19]

Benz

[11] Patent Number: 4,763,786

[45] Date of Patent: Aug. 16, 1988

[54] LOCKING DEVICE FOR A ROLL

[76] Inventor: William F. Benz, 7-4465 Imperial Street, South Burnaby, British Columbia, Canada, V5J 1B4

[21] Appl. No.: 37,424

[22] Filed: Apr. 13, 1987

[51] Int. Cl.[4] ..... B65D 85/671

[52] U.S. Cl. ..... 206/408; 81/487; 242/55.53

[58] Field of Search ..... 81/3.8, 487, 488; 206/389, 390, 392, 397, 407–411; 242/55.53, 68.4, 129.6

[56] References Cited

U.S. PATENT DOCUMENTS

| | | | |
|---|---|---|---|
| 2,624,521 | 1/1953 | Broeren | 242/55.53 |
| 3,184,053 | 5/1965 | Eldridge | 242/55.53 |
| 3,229,812 | 1/1966 | Metzger | 229/175 |
| 3,283,892 | 11/1966 | Rosen | 206/392 |
| 3,338,399 | 8/1967 | Burt | 206/408 |
| 4,395,297 | 7/1983 | Patterson | 248/205.3 |
| 4,445,645 | 5/1984 | Byer | 242/55.53 |

*Primary Examiner*—Jimmy G. Foster

*Attorney, Agent, or Firm*—Fulwider, Patton, Rieber, Lee & Utecht

[57] ABSTRACT

A retaining device for retaining a roll of material in a box. The roll has a hollow inner core and the box has side and end walls. The device includes a base and a projection extending outwardly from the base and able to extend into the hollow core of the roll to allow the roll to rotate along its longitudinal axis but to prevent the core from being pulled out of the box. The projection is positioned to engage against the inner surface of the hollow core. The base can be secured to an end wall of the box. The invention includes a system for placing the retaining device in position in the box.

4 Claims, 2 Drawing Sheets

LOCKING DEVICE FOR A ROLL

FIELD OF THE INVENTION

This invention relates to a roll retaining device to affix to the inside end walls of a box to contain a roll of material, such as foil or paper, to allow the roll to rotate about its longitudinal axis to dispense material. The device prevents the roll from tilting or being pulled out of the box during the dispensing.

DESCRIPTION OF THE PRIOR ART

It is a common problem with material wound onto a core or roll to be dispensed from an opening in a box or carton or through the open top of the box or carton that, when being unrolled, the roll tends to be pulled out of the dispensing container as there is usually no retaining means supplied with the container.

The prior art in this field contains numerous examples of dispensing devices that use rolls or spools of material which include retaining means. However all these devices are either built into the end walls of the dispensing container or involve piercing the end wall of the container. Building retaining means increases the cost of the disposable boxes and piercing the end wall of the container to insert a retaining means can require effort and may affect the structure and integrity of the container being pierced.

The prior art in this field known to applicant includes U.S. Pat. Nos. 3,880,286 to Loeffelman; 3,195,721 to Weckesser; 4,445,645 to Byer; and 3,121,542 to Van Dyke. Of the above Byer is believed to be of most interest and the prior art cited against the application that led to the above U.S. patent to Byer. That cited prior art comprises U.S. Pat. Nos. 391,379 to Mitchamore; 1,122,674 to Winter; 2,381,229 to Shalhoub; 2,579,149 to Krueger; 2,743,009 to Williamson; 2,836,292 to Klein; 2,861,753 to Sipior and 3,228,579 to Dong.

SUMMARY OF THE INVENTION

The present invention seeks to provide a simple, easy to make and economical retaining means that is easily installed manually into an existing dispensing box and does not contain any integral roll retaining means and which does not involve compromising the structure and integrity of the dispensing box.

Accordingly, the present invention is a retaining device for retaining a roll of material in a box, the roll having a hollow inner core and the box having side and end walls, said device comprising: (a) a base; (b) a projection extending outwardly from the base and able to extend into the hollow core of the roll to allow the roll to rotate along its longitudinal axis but to prevent the core from being pulled out of the box, said projection being positioned to engage against the inner surface of the hollow core; (c) attachment means to allow said base to be secured to an end wall of the box; and (d) means for placing the retaining means in position in the box.

DRAWINGS

Aspects of the invention are illustrated, merely by way of example, in the accompanying drawings in which.

DESCRIPTION OF THE PREFERRED EMBODIMENTS

The drawings show a roll retaining device for retaining a roll 2 of material in a box 4. The roll 2 has a hollow inner core 6 and the box has side and end walls 8 and 10. Typically the box is of lightweight cardboard such as would be used to dispense paper or aluminum foil.

Figure 3:
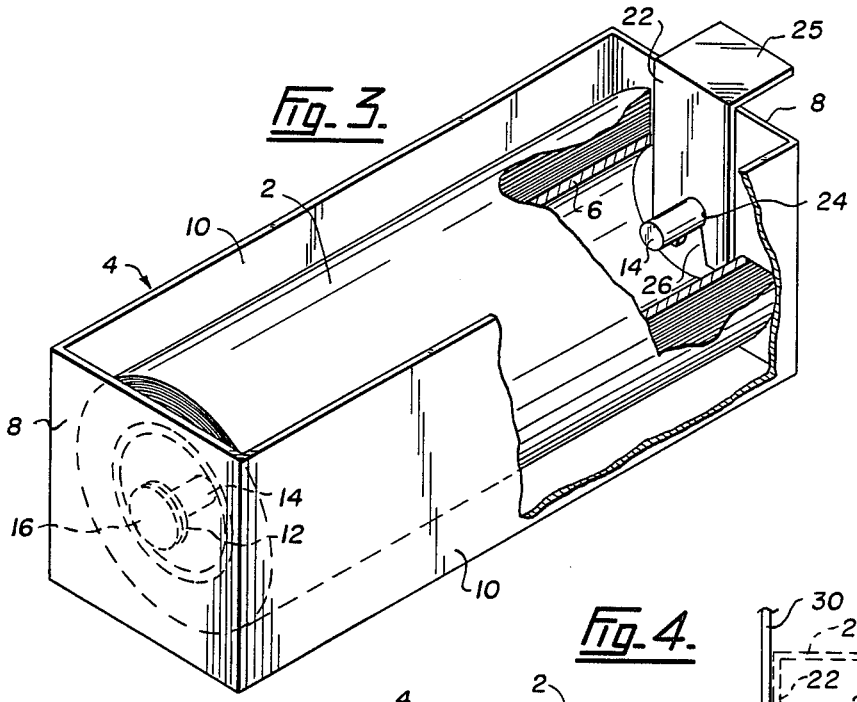
FIG. 3 is an isometric view showing retaining means in position in a carton, containing a roll, and a means of installing the retaining means.
Figure 4:
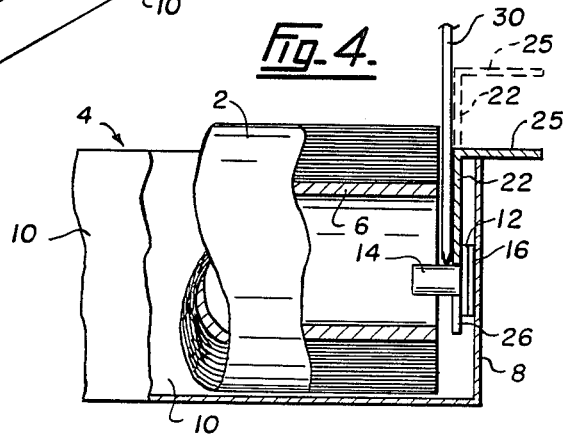
FIG. 4 is a detail illustrating in more detail the installation of the retaining means.

The retaining device comprises a base 12 from which extends a projection 14. The projection, as shown in FIGS. 3 and 4, extends into the hollow core 6 and, when properly positioned, allows the roll 2 to rotate along its longitudinal axis but prevents it from being pulled out of the box 4 by engaging against the lower inner surface of the hollow core.

Figure 1:
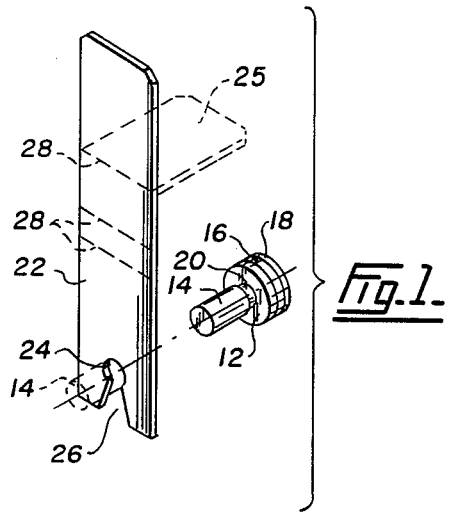
FIG. 1 is an isometric view of an embodiment of the attachment means useful in the present invention.
Figure 2:
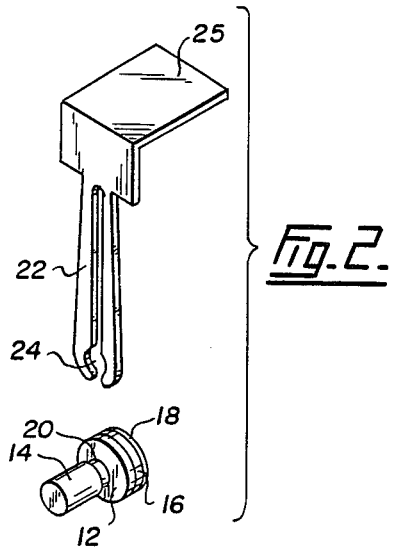
FIG. 2 is a second embodiment of an attachment means useful in the present invention.

As shown in FIGS. 1 and 2 the base 12 is formed with attachment means in the form of a pressure sensitive adhesive 16 and there is a protective layer 18 attached to the adhesive 16, to render it ineffective, during storage. This arrangement is, of course, entirely conventional with pressure sensitive adhesives. FIG. 2 shows a narrow section or neck 20 between the base 12 and the projection 14.

As shown in all the drawings the invention includes means for placing the retaining device in position in the box. This device comprises an elongated member 22 with an opening 24 adjacent one end. The cavity is dimensioned to be a close, frictional, relatively tight fit on the projection 14 or, if present, neck 20. As shown in FIG. 1 it is desirable that there by a guiding section, comprising a truncated V-slot 26 extending to the lower edge of the member 22. In the embodiment shown in FIG. 1 there are lines 28 marked on the surface of the member.

Generally FIG. 1 is a disposable member 22, made of cardboard, and FIG. 2 shows a more elaborate member 22, molded of plastic and reusable. FIG. 2 shows the formation of a 90° bend at the end of the member 22 remote from the opening 24 to form a tab 25. Tab 25 is formed in the member 22 of FIG. 1 by bending.

The locating means according to the present invention is provided in pairs to be used as shown in FIG. 3. When it is desired to use the retaining means according to the present invention a first base 12, with its projecting member 14, is attached to one end wall 8 of a box 4, typically at about the centre of the end wall but, in any event, in such a position as to permit the location of the roll 6 within the box. To do this the roll 6 may be removed from the box and the protective sheet 18 removed from the adhesive 16. The base is then adhered with adequate pressure at about the centre of the wall and the roll 6 with material 2 returned to the box 4.

Figure 5:
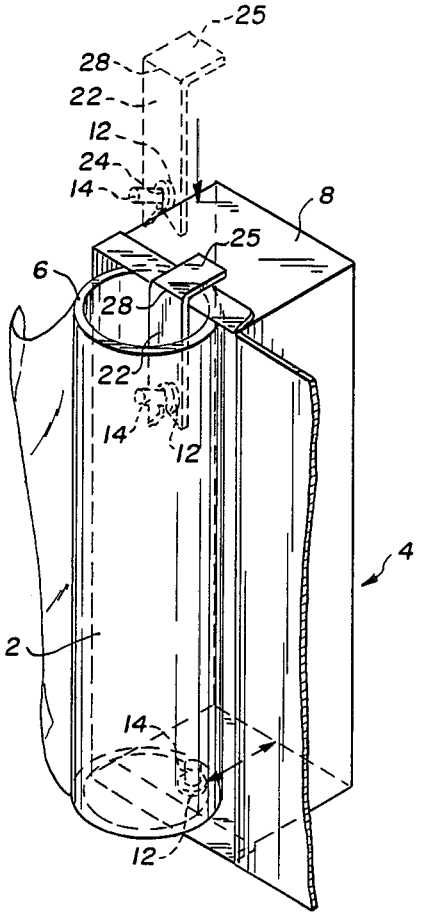
FIGS. 5 and 6 show the installation of the attachment means.
Figure 6:
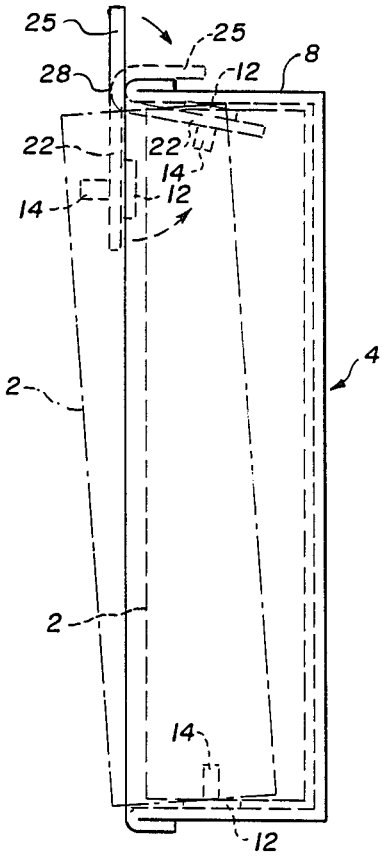

Referring to FIGS. 5 and 6, to attach the second base 12 first a measurement is carried out of the dimensions of the box 4 and, with the embodiment of FIG. 1, the appropriate line 28 selected to ensure that the distance from the opening 24 to that line 28 is the distance at which it is desired to position the base 12 from the top edge of the end 8 of the box 4. The tab 25 is then folded.

The retaining device is located in the positioning member 22 before the measurement and folding of tab 25—see FIG. 5. The protective layer 18 is then removed from the adhesive 16. With the core 6 projecting upwardly out of the box 4 as shown in FIG. 5 the member 22 is inserted longitudinally into the core 6 with the tab 25 rested flat downwardly against box end 8 and against the upper edge of the box, that is with the chosen line 28 in alignment with the upper edge.

The roll is then moved downwardly as shown in FIG. 6, with the member 22 held in the desired position until the core 6 forces the member 22 outwardly, against the end 8 of the box to bring the adhesive 16 into contact with the surface. As shown particularly in FIG. 4 it is desirable to insert a thin member 30, for example the blade of a knife, to ensure that pressure is applied to the adhesive layer 16 to ensure that it is adequately located. The member 30 is then withdrawn and, subsequently, the member 22 pulled upwardly—see the broken line in FIG. 4—so that it leaves the retaining device in position. The invention is then ready to use. When material is pulled off the roll 2 the roll may move upwardly, as in the prior art devices, but the lower surface of the core 6 contacts the projections 14 so that it cannot move from the box.

In the FIG. 2 embodiment the tab 25 is formed integrally and the plastic can bend through the angle required by the insertion of the core 6.

If desired a member 22 can also be used to locate the first base 12, that is with the core 6 outside the box, to ensure that both projections are in the same position on their respective ends 8 of the box 4.

I claim:

1. In a box with a retaining device for retaining a roll of material therein, the roll having a hollow inner core and the box having side and end walls, an improved retaining device comprising:

retaining means comprising a base without attachment means to allow the base to be secured to the end wall of the box; a projection extending outwardly from the base and able to extend into the hollow core of the roll to allow the roll to rotate along its longitudinal axis but to prevent the core from being pulled out of the box, said projection being positioned to engage against the inner surface of the hollow core and having a narrowed section immediately adjacent said base to provide an area to be gripped by means for placing the retaining means; and said means for placing the retaining means comprising an elongated member with a cavity at one end shaped to releasably hold said narrowed section of said projection.

2. A device as claimed in claim 1 in which the attachment means comprises an adhesive layer on the base, on the surface of the base remote from that from which the projection extends.

3. A device as claimed in claim 1 in which the means for placing the retaining means has a 90° bend at the end opposite the cavity to rest against the upper edge of the end wall of said box to position the device at a predetermined depth in the box, against the end wall.

4. A device as claimed in claim 1 in which said retaining means are supplied as a pair with a single means for placing the retaining means in position.

* * * * *